US006470958B1

(12) United States Patent
Solvi et al.

(10) Patent No.: US 6,470,958 B1
(45) Date of Patent: Oct. 29, 2002

(54) METHOD OF PRODUCING A COOLING PLATE FOR IRON AND STEEL-MAKING FURNACES

(75) Inventors: Marc Solvi, Ehlange; Roger Thill, esch sur Alzette, both of (LU); Yrio Leppanen; Perrtti Makinen, both of Pori (FI)

(73) Assignees: Paul Wurth S.A., Luxembourg (LU); Outokumpu Proicopper Oy, Kuparitie (FI)

( * ) Notice: Subject to any disclaimer, the term of this patent is extended or adjusted under 35 U.S.C. 154(b) by 0 days.

(21) Appl. No.: 09/341,057

(22) PCT Filed: Jan. 5, 1998

(86) PCT No.: PCT/EP98/00021

§ 371 (c)(1),
(2), (4) Date: Aug. 5, 1999

(87) PCT Pub. No.: WO98/30345

PCT Pub. Date: Jul. 16, 1998

(30) Foreign Application Priority Data

Jan. 8, 1997 (LU) ..... 90003
Sep. 30, 1997 (LU) ..... 90146

(51) Int. Cl.[7] ..... B22D 11/00; B22D 1/08
(52) U.S. Cl. ..... 164/465; 164/421
(58) Field of Search ..... 164/461, 465, 164/464, 421

(56) References Cited

U.S. PATENT DOCUMENTS 3,136,008 A * 6/1964 Maier et al. ..... 22/57.2
4,382,585 A * 5/1983 Fischer et al. ..... 266/199

FOREIGN PATENT DOCUMENTS

| | | | |
|---|---|---|---|
| DE | 11 61 664 | | 1/1964 |
| DE | 29 07 511 | | 9/1980 |
| DE | 40 35 893 | | 1/1992 |
| DE | 296 11 704 | | 10/1996 |
| EP | 0 365 757 | | 5/1990 |
| FR | 1 432 629 | | 6/1966 |
| GB | 1 571 789 | | 7/1980 |
| JP | 37-61 | * | 1/1962 |
| JP | 59-141347 | * | 8/1984 |

OTHER PUBLICATIONS

H. Coolidge "Iron Parts Without Patterns", Machine Design., Bd 57, Nr. 26, Nov. 26, 1985, Cleveland, Ohio, USA, pp. 79–82, XP002064871, p. 81 right column.

W. Klein "Stranggegossene Werkstücke...", Werkstatt Und Betrieb., Bd 115, Nr. 10, Oct. 10, 1982, München, Germany, pp. 672–674, XP002064872, p. 672; Fig. 1.

* cited by examiner

*Primary Examiner*—M. Alexandra Elve
*Assistant Examiner*—Kevin McHenry
(74) *Attorney, Agent, or Firm*—McCormick, Paulding & Huber LLP

(57) ABSTRACT

A method for production of a cooling plate (50, 80) with integrated coolant ducts (52, 84) for iron and steel making furnaces, in particular blast furnaces, is described. A preform of the cooling plate (50, 80) is continuously cast by a continuous casting mould (10), wherein rod-shaped inserts (28) in the casting duct (20) of the continuous casting mould (10) produce in this preform ducts (52, 84) running in the continuous casting direction, which form coolant ducts in the finished cooling plate.

18 Claims, 3 Drawing Sheets

METHOD OF PRODUCING A COOLING PLATE FOR IRON AND STEEL-MAKING FURNACES

The present invention relates to a method for production of a cooling plate for iron and steel making furnaces, as e.g. blast furnaces.

BACKGROUND OF THE INVENTION

Such cooling plates for blast furnaces are also called "staves". They are arranged on the inside of the furnace armour and have internal coolant ducts, which are connected to the cooling system of the shaft furnace. Their surface facing the interior of the furnace is generally lined with a refractory material.

Most of these "staves" are still made from cast iron. As copper has a far better thermal conductivity than cast iron, however, it would be desirable to use copper "staves". So far a number of production methods have been proposed for copper "staves".

Initially an attempt was made to produce copper cooling plates by casting in moulds, the internal coolant ducts being formed by a sand core in the casting mould. However, this method has not proved to be effective in practice, because the cast copper plates often have cavities and porosities, which have an extremely negative effect on the life of the plates, the mould sand is difficult to remove from the cooling ducts, and/or the cooling duct in the copper is not properly formed.

It is already known from GB-A-1571789 how to replace the sand core by a pre-shaped metal pipe coil made from copper or high-grade steel when casting the cooling plates in moulds. The coil is integrally cast into the cooling plate body in the casting mould and forms a spiral coolant duct. This method has also not proved effective in practice. A high heat transmission resistance exists between the cooling plate body made from copper and the integrally cast pipe coil for various reasons, so that relatively poor cooling of the plate results. Furthermore, cavities and porosities in the copper can likewise not be effectively prevented with this method.

A cooling plate made from a forged or rolled copper ingot is known from DE-A-2907511. The coolant ducts are blind holes introduced by mechanical drilling in the rolled copper ingot. With these cooling plates the above-mentioned disadvantages of casting are avoided. In particular, cavities and porosities in the plate are virtually precluded. Unfortunately the production costs of these cooling plates are relatively high, however, because the drilling of the cooling ducts in particular is complicated, time-consuming and expensive.

Consequently a method with which high-quality copper cooling plates can be manufactured more cheaply is required.

According to the invention a preform of the cooling plate is continuously cast by means of a continuous casting mould, wherein inserts in the casting duct of the continuous casting mould produce ducts running in the continuous casting direction in the preform, which form coolant ducts in the finished cooling plate. A long cooling plate ready for use can then be manufactured relatively easily from the continuously cast preform without time-consuming drilling. It should be specially noted in this connection that cavities and porosities can be prevented far more effectively in continuous casting than in casting in moulds. Furthermore, the mechanical strength of a continuously cast cooling plate is far higher than that of one cast in a mould. The heat transmission is optimum, because the continuously cast ducts are formed directly in the cast body. As the cross-section of the continuously cast ducts need not be circular, new advantageous possibilities concerning the design and arrangement of the coolant ducts are opened up. It was also established that the special quality of the surface of a continuously cast cooling plate creates good preconditions for the adhesion of a refractory spraying compound.

During continuous casting prongs in the casting duct of the continuous casting mould can produce grooves running in the casting direction in a surface of the preform. These grooves increase the cooled surface of the finished cooling plate and form anchoring points for a refractory lining. However, such grooves can also be subsequently worked, e.g. cut, into a surface of the continuously cast preform. This procedure is necessary for example, if the grooves are to run at right angles to the continuous casting direction.

If particularly thin cooling plates are to be manufactured, the thickness of the continuously cast preform is advantageously reduced by rolling. The rolling makes the crystalline structure of the copper finer, which has a favourable effect on the mechanical and thermal properties of the finished cooling plate. Although the reduction by rolling increases the production costs of the cooling plate, it may thus be advantageous also to roll continuously cast preforms for thicker cooling plates. In this connection it should be emphasised that the ducts integrally cast into the preform surprisingly do not constitute an important obstacle to the subsequent rolling of the preform. This applies in particular, if the integrally cast ducts have an elongated, e.g. oval cross-section.

A plate is cut out of the continuously cast and if necessary rolled preform by two cuts at right angles to the casting direction, two end faces being formed at right angles to the casting direction, the distance between them corresponding essentially to the required length of the cooling plate. It should be noted that several cooling plates of the same or different length can advantageously be manufactured from one continuously cast preform. The production of particularly long cooling plates is likewise possible without additional cost. The plates cut from the preform have several parallel through ducts, which extend in the casting direction and terminate in the two ends.

The cross-section of the integrally cast ducts advantageously has an elongated shape with its smallest dimension at right angles to the cooling plate. In this way, cooling plates with a smaller plate thickness than those with drilled ducts can be manufactured, with the result that copper is saved. It should likewise be noted that ducts with elongated cross-sections can also be produced more easily in continuous casting. A further advantage is that in the case of ducts with elongated cross-sections larger exchange surfaces on the coolant side can be achieved in the cooling plate. Ducts with elongated (e.g. oval) cross-sections, as already described above, behave far more advantageously during rolling of the preform than ducts with circular cross-sections.

In the next production step connection holes terminating in the through ducts for feed and return pipes are advantageously drilled in the plate at right angles to the back, and the end terminations of the ducts are sealed. Connection pieces, which are led out of the furnace armour when a cooling plate is mounted on the latter, can subsequently be inserted in these connection holes.

Each continuosly cast duct can have its own feed and return connection Several continuously cast ducts can, however, also be connected to each other by transverse holes. These transverse holes are, for example, then arranged and sealed in such a way that a serpentine duct with a feed connection and return connection for each cooling plate results.

The cooling plate can advantageously be bent and centered in such a way that its curvature is adapted to the curvature of the blast furnace armour. This is the case in particular if cooling plates with a large width are used. This is likewise the case for cooling plates used in the blast furnace hearth. Such cooling plates for the hearth must in fact fit as closely as possible to the armour to absorb the pressures acting on the hearth lining.

BRIEF DESCRIPTION OF THE DRAWINGS

For better illustration of the invention and its advantages different forms of construction are described in greater detail with reference to the enclosed drawings.

DETAILED DESCRIPTION OF THE PREFERRED EMBODIMENT

Figure 1:
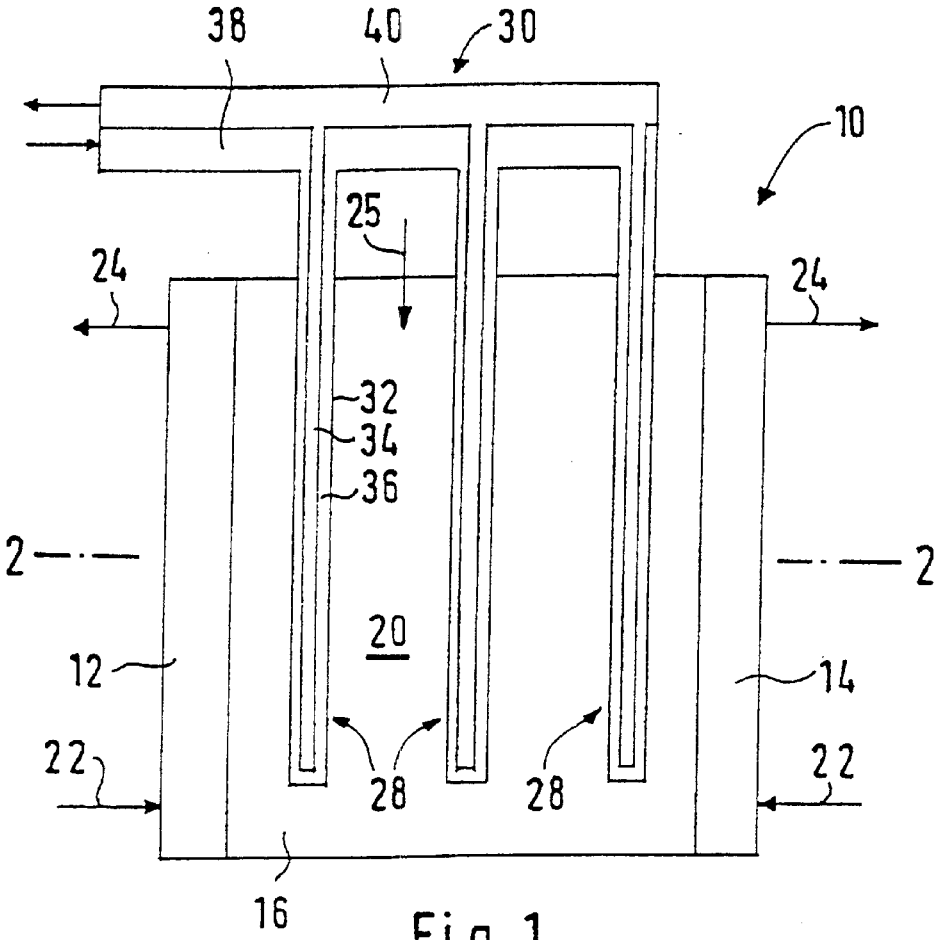
FIG. 1 shows a schematic longitudinal section through a continuous casting mould for the method according to the invention.
Figure 2:
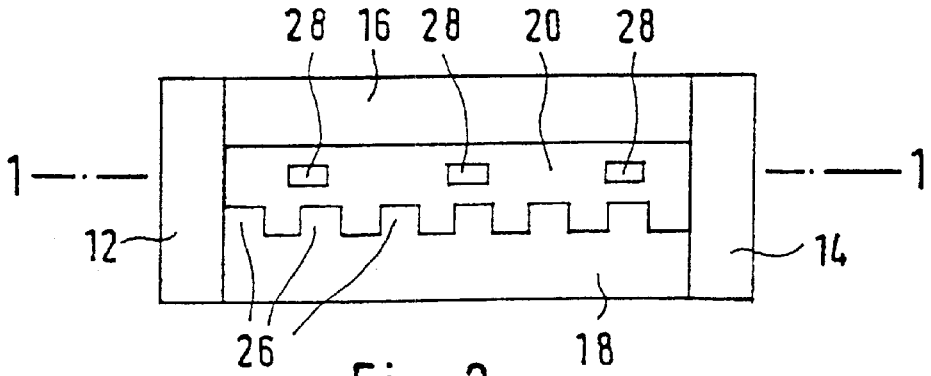
FIG. 2 a schematic cross-section along the section line 2—2 through the continuous casting mould according to FIG. 1.

FIGS. 1 and 2 show schematically the construction of a continuous casting mould 10 for the method according to the invention. This continuous casting mould 10 consists, for example, of four cooled mould plates 12, 14, 16 and 18, which form a cooled casting duct 20 for a melt, e.g. a low-alloyed copper melt. The arrows 22 and 24 in FIG. 1 indicate feed and return connections for a coolant in the lateral mould plates 12 and 14. The arrow 25 in FIG. 1 shows the casting direction.

In FIG. 1 it can be seen that three rod-shaped inserts 28 project into the casting duct 20. The inserts are connected, for example, to a coolant collector 30, which is arranged above the mould plates 12-18 above the casting duct 20. Each of these rod-shaped inserts 28 advantageously consists of an outer tube 32 closed at the end and an inner tube 34 open at the end, which are arranged in such a way that they form an annular gap 36 for the coolant. The following coolant flow thus results for each of the three rod-shaped inserts 28. In the collector 30 the coolant flows via a feed chamber 38 into the annular gap 36. It cools the outer tube 32 over its full length and at the bottom end enters the inner tube 34 from the annular gap 36. This inner tube 34 returns the coolant, to a return chamber 40 in the collector 30. The rod-shaped inserts 28 can, however, also be designed as uncooled graphite rods.

In FIG. 2 it can be seen that the front mould plate 16 has several prongs 26. The latter extend essentially over the full length of the mould plate 16 and project at right angles to the casting direction into the casting duct 20.

According to the invention, a billet or ingot, which forms a preform of the cooling plate to be manufactured, is cast with the continuous castng mould 10 described above. The rod shaped inserts 28 produce ducts with a cross-section determined by the cross-section of the rod shaped inserts 28 in the continuous casting direction in the continuously cast preform. The prongs 26 in the mould plate 8 produce longitudinal grooves in the continuous casting direction in the continuously preform.

Figure 3:
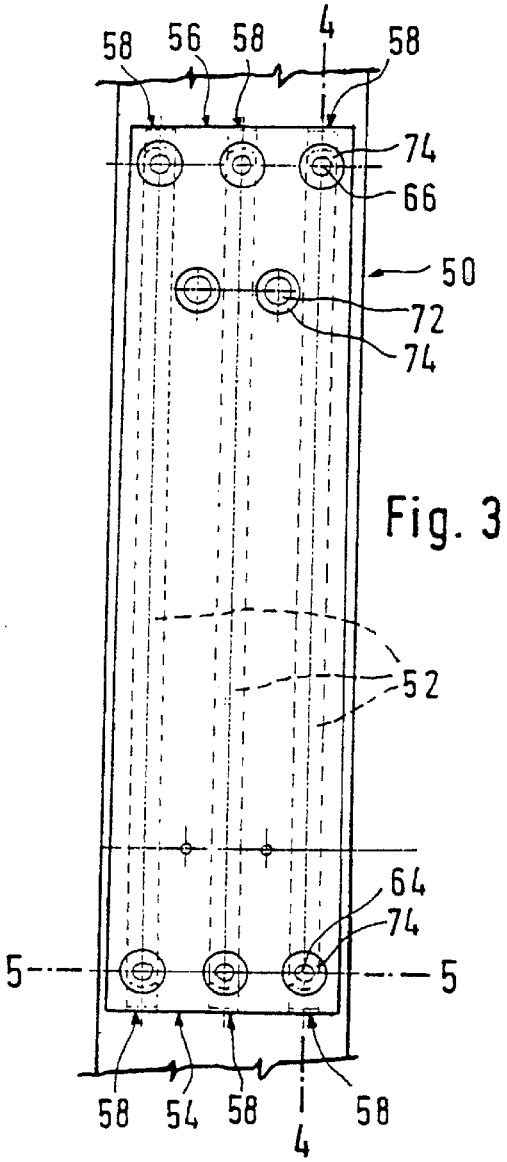
FIG. 3 a plan view of the back of a finished cooling plate which has been manufactured by the method according to the invention.
Figure 4:
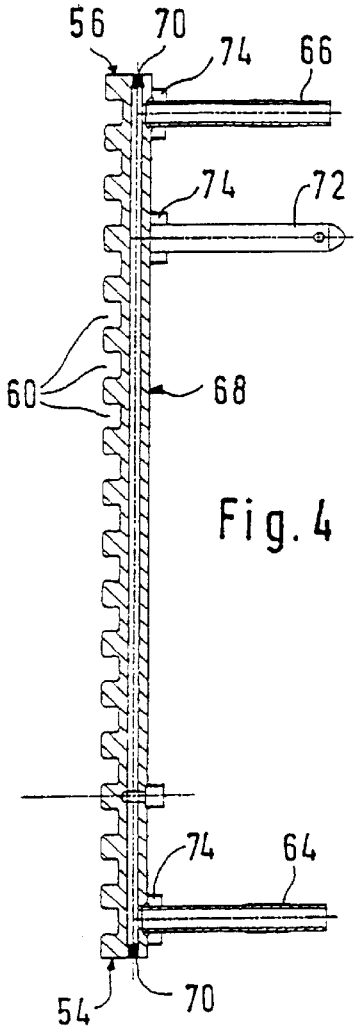
FIG. 4 a longitudinal section along the section line 4—4 through the cooling plate in FIG. 3.
Figure 5:
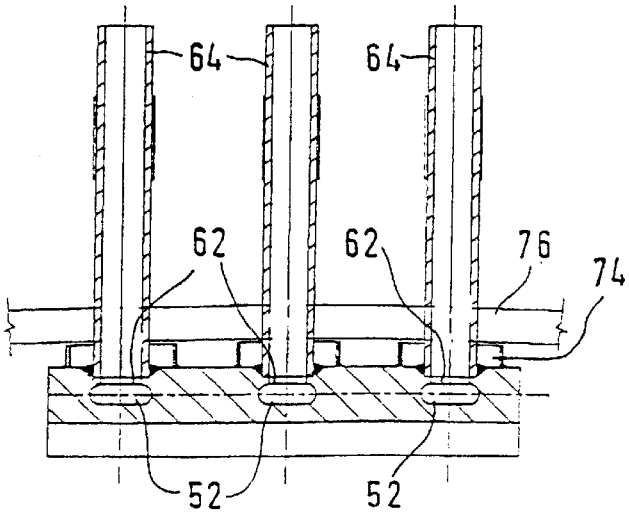
FIG. 5 a cross-section along the section line 5—5 through the cooling plate in FIG. 3.

FIGS. 3 to 4 show a finished cooling plate 50 manufactured on the basis of a continuously cast preform. It should be noted, however, that the preform of the cooling plate 50 was cast with a continuous casting mould which had no prongs 26, so that the original preform had essentially a rectangular cross-section without grooves. In FIG. 3 the three ducts 52, which were produced according to the invention by the inserts in the continuous casting mould during continuous casting, are indicated by broken lines. As shown in FIG. 5, these inserts had an oval shape. They were arranged eccentrically in the rectangular cross-section of the preform in the continuous casting mould, as shown in FIGS. 4 and 5, i.e. they were nearer to the surface of the preform, which finally forms the back of the finished cooling plate 50.

It has proved to be advantageous to cast the preform thicker than required for the finished cooling plate and subsequently to reduce the thickness of the preform by rolling to the thickness of the finished cooling plate. With this rolling of the preform the copper acquires a finer crystalline structure, which has a favourable effect on the mechanical and thermal properties of the finished cooling plate. It remains to state in this connection that an elongated cross-section of the cooling ducts from the outset is deformed far more advantageously during rolling than a circular cross-section.

A rectangular rough plate was subsequently cut out of the rolled preform by two cuts at right angles to the casting direction. The two end faces 54, 56 of the finished cooling plate were formed in this way. In this rough plate the ducts 52 consequently extended as through ducts between the two end faces 54, 56 and formed open terminations 58 therein. Grooves 58 were subsequently cut at right angles to the casting direction in the surface of this rough plate which was furthest away from the eccentric ducts 52. To increase the mechanical strength of the plate still further, it could now be shot peened.

In the next production step connection holes 62 for feed and return pipes 64, 66 terminating in the ducts 52 were drilled at right angles to the plate surface in the back 68 of the plate. Before the end terminations 58 of the ducts 52 are finally closed by plugs 70, the ducts could if necessary be finished mechanically. To complete the cooling plate 50 definitively only the feed and return connection pieces 64, 66 as well as the securing pins 72 and spacer connection pieces 74 had to be mounted on the plate.

In FIG. 5 it can be seen how the finished cooling plate 50 rests by means of the spacer connection pieces 74 on a furnace armour plate 76. It should be noted that the cooling plate 50 in FIGS. 3–5 is intended for vertical installation in the furnace, i.e. the cooling ducts 52 run vertically and the transverse grooves 60 horizontally in the built-in cooling plates. Instead of the transverse grooves 60, which run at right angles to the casting direction, the cooling plate 50 could also have longitudinal grooves, which run parallel with the casting direction. The latter would then advantageously be produced directly during continuous casting with a casting mould with prongs, as shown in FIG. 2.

Figure 6:
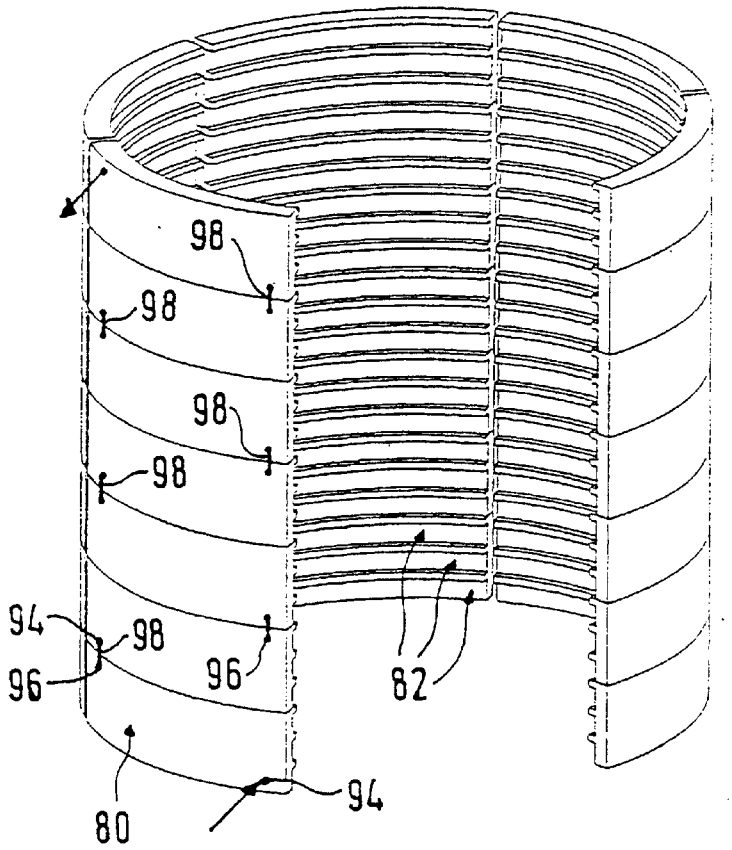
FIG. 6 a perspective elevation of an arrangement of cooling plates in a shaft furnace.

FIG. 6 shows an arrangement of cooling plates 80, in which the grooves 82 were produced in this way directly during continuous casting. Inside the cooling plates 80 the cooling ducts 84 produced during continuous casting (see FIG. 7) therefore extend parallel with the grooves 82. It should be noted that the cooling plates 80 are arranged horizontally in the furnace, i.e. the cooling ducts 84 and grooves 82 run horizontally in the built-in cooling plates 80. The cooling plates 80 are bent and centered in such a way that their curvature is adapted to the curvature of the blast furnace armour (not shown).

Figure 7:
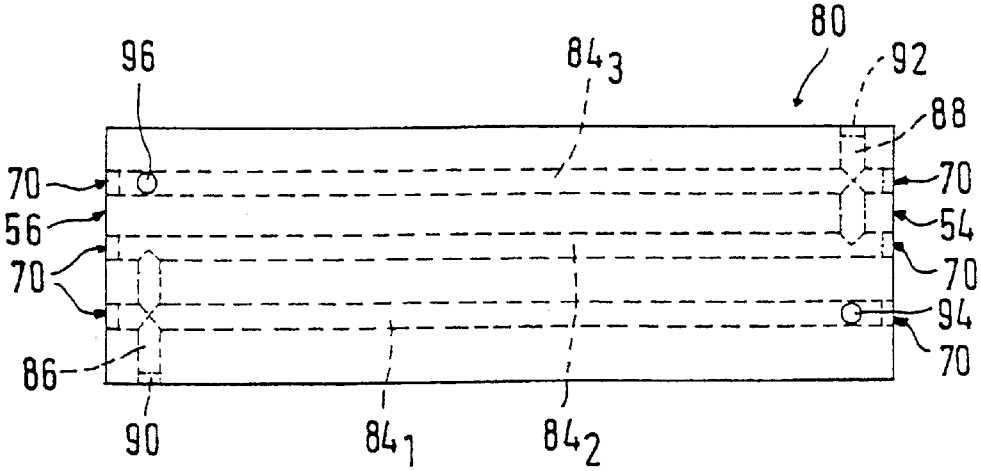
FIG. 7 a plan view of the back of a cooling plate which is particularly suitable for the arrangement according to FIG. 6 and has been manufactured by the method according to the invention.

FIG. 7 shows with broken lines an advantageous arrangement of the coolant ducts in one of the cooling plates 80. Three continuously cast ducts $\mathbf{84}_1$, $\mathbf{84}_2$ and $\mathbf{84}_3$ as well as two short transverse holes 86 and 88 can be seen. The hole 86 connects the ducts $\mathbf{84}_1$ and $\mathbf{84}_2$ at one end of the plate 80 and is closed by a plug 90. The hole 88 connects the ducts $\mathbf{84}_2$ and $\mathbf{84}_3$ at the other end of the plate 80 and is closed by a plug 92. Like the ducts 52 in plate 50, the ducts $\mathbf{84}_1$, $\mathbf{84}_2$ and $\mathbf{84}_3$ in the end faces 54, 56 of the plate 80 are likewise closed by plugs 70. The reference number 94 indicates a feed connection, which terminates in the duct $\mathbf{84}_1$, and the reference number 96 a return connection which terminates in the duct $\mathbf{84}_3$. The coolant, which enters the plate 80 via feed connection 94, must flow through the latter spirally before it can leave it again via the return connection 96. In FIG. 6 it is shown schematically how the feed and return connections 94, 96 of the individual cooling plates 80 are connected to each other via pipe bridges 98. The cooling plate 80 could, of course, have a feed and return connection for each cooling duct $\mathbf{84}_1$, $\mathbf{84}_2$ and $\mathbf{84}_3$ like the cooling plate 50.

It should be noted that cooling plates mounted in the blast furnace above the blast tuyeres are advantageously provided with a refractory spraying compound on their side facing the interior of the furnace. To improve the adhesion of the refractory spraying compound to the cooling plates, the grooves 60, 82, for example, can be designed as dovetail grooves. It is also advantageous to round the edges and corners of the grooves 60, 82 generously. This reduces the risk of crack formation in the refractory compound.

By contrast, cooling plates for the blast furnace hearth advantageously have a smooth front and back. They are thinner than the cooling plates shown with grooves and are advantageously made from a continuously cast preform, the thickness of which has been reduced by rolling. They are centered on the diameter of the armour in the hearth area, so that they rest with a close fit with their smooth back on the blast furnace armour. The hearth lining with shaped bricks made from carbon rests with a close fit against the likewise smooth front of the cooling plates. In this way it is ensured that relatively thin cooling plates can easily transmit the high pressures acting on the hearth lining to the blast furnace armour.

All cooling plates shown have three continuously cast ducts. Cooling plates with more or less than three continuously cast ducts can, of course, likewise be manufactured by the method according to the invention.

What is claimed is:

1. A method of manufacturing a cooling plate for iron and steel making furnaces, said method comprising the steps of:

continuously casting an ingot of copper with cast-in ducts extending in the continuous casting direction; and cutting out a plate of said ingot of copper by two cuts at right angles to the continuous casting direction, whereby two end faces are formed, wherein said cast-in ducts form openings;

drilling connection holes for feed and return pipes from a plate surface into said cast-in ducts;

sealing said openings in said two end faces of said plate; and wherein said cast-in ducts remain continually open to form coolant ducts in the finished cooling plate.

2. The method according to claim 1, further comprising the step of working grooves into a surface of said continuously cast ingot of copper.

3. The method according to claim 1, wherein said cast-in ducts have a cross-section which has an elongated shape.

4. The method according to claim 1, further comprising the step of interconnecting aid cast-in ducts by transverse bore holes.

5. The method according to claim 4, wherein said transverse bore holes are arranged and sealed in such a way that a serpentine duct with a feed connection and a return connection is formed.

6. The method according to claim 1, further comprising the step of rolling said reform.

7. A method of manufacturing a cooling plate for iron or steel making furnaces, said method comprising the steps of:

continuously casting an ingot of copper using a continuous casting mould with rod-shaped inserts, wherein said rod-shaped inserts produce cast-in ducts extending through said ingot of copper in the continuous casting direction; and using said ingot of copper with said cast-in ducts as a preform of said cooling plate; and transforming said preform of said cooling plate into a finished cooling plate, wherein said cast-in ducts remain continually open to form coolant ducts in the finished cooling plate.

8. The method according to claim 7, wherein said continiuous casting mould has prongs to produce cast-in grooves extending in a sure of said preform in the the continuous casting direction.

9. The method according to claim 7, further comprising the step of working grooves into a surface of said preform, wherein said groove run at right angles to the continuous casting direction.

10. The method according to claim 7, further comprising the step of cutting out a plate of said preform by two cuts at right angles to the continuous casting direction; whereby two end faces are formed, wherein said cast-in ducts form openings.

11. The method according to claim 7 further comprising the steps of:

drilling connection holes for feed and return pipes from a plate surface from a plate surface into said cast-in ducts, and selling said opens in said two faces of said plate.

12. The method according to claim 7, wherein said cast-in ducts have a cross-section which has an elongated shape.

13. The method according to claim 12, wherein; said cooling plate has a front face; and said cross-section has its smallest dimension at right angles to said front face of said cooling plate.

14. The method according to claim 7, further comprising the step of interconnecting said cast-inducts by transverse bore holes.

15. The method according to claim 14, wherein said transverse holes are arranged and sealed in such a way that a serpentine coolant duct with a feed connection and a return connection is formed.

16. The method according to claim 7, further comprising the step of bending said preform in such a way that its curvature is adapted to the curvature to the curvature of the wall of a shaft furnace.

17. The method according to claim 7 wherein said preform is cast of copper alloy.

18. The method according to claim 7 further comprising the step of rolling said preform.

* * * * *